US010888169B1

(12) United States Patent
Ma

(10) Patent No.: US 10,888,169 B1
(45) Date of Patent: Jan. 12, 2021

(54) ELECTRIC SOFA FRAME

(71) Applicant: Dongguan Jackwell Hardware Co., Ltd, Dongguan (CN)

(72) Inventor: Jianhui Ma, Dongguan (CN)

(73) Assignee: DONGGUAN JACKWELL HARDWARE CO., LTD, Dongguan (CN)

( * ) Notice: Subject to any disclaimer, the term of this patent is extended or adjusted under 35 U.S.C. 154(b) by 0 days.

(21) Appl. No.: 16/510,334

(22) Filed: Jul. 12, 2019

(51) Int. Cl.

| | |
|---|---|
| ***A47C 17/04*** | (2006.01) |
| ***A47C 7/38*** | (2006.01) |
| ***A47C 7/46*** | (2006.01) |
| ***A47C 1/032*** | (2006.01) |
| *A61G 5/14* | (2006.01) |

(52) U.S. Cl.
CPC ..... *A47C 17/04* (2013.01); *A47C 1/032* (2013.01); *A47C 7/38* (2013.01); *A47C 7/462* (2013.01); *A61G 5/14* (2013.01)

(58) Field of Classification Search
CPC ..... A47C 17/04; A47C 1/032; A47C 7/38; A47C 7/462; A61G 5/14
See application file for complete search history.

(56) References Cited

U.S. PATENT DOCUMENTS

| | | | | |
|---|---|---|---|---|
| 4,966,413 | A * | 10/1990 | Palarski | A47C 1/022 297/284.6 |
| 8,608,240 | B2 * | 12/2013 | Marshall | A47C 1/0242 297/69 |
| 10,104,977 | B2 * | 10/2018 | Li | A47C 7/38 |
| 10,306,986 | B1 * | 6/2019 | Gu | A47C 7/38 |
| 10,376,063 | B2 * | 8/2019 | Donovan | A47C 7/462 |
| 2017/0181549 | A1 * | 6/2017 | Donovan | B60N 2/66 |
| 2018/0338625 | A1 * | 11/2018 | Nava | A47C 19/02 |
| 2020/0154888 | A1 * | 5/2020 | Brown | A47C 20/041 |

* cited by examiner

*Primary Examiner* — Philip F Gabler
(74) *Attorney, Agent, or Firm* — Sinorica, LLC

(57) ABSTRACT

Furniture seats, in particular relate to an electric sofa frame, comprising a bottom frame assembly, a sofa mounting frame, a leg assembly, a back assembly, a linkage mechanism and a first driving electric motor for driving the movement of the linkage mechanism. The movement of the linkage mechanism may cause the leg assembly and/or the back assembly to expand or contract; and further includes a fixing frame, a headrest assembly, a waistrest assembly, a second drive electric motor for driving rotation of the waistrest assembly, and a third driving electric motor that drives the headrest assembly to rotate; the headrest assembly and the waistrest assembly are connected to the back assembly via a mount. The utility model has the advantages of simple and compact structure, stable and reliable operation and can be used for providing the user with the head support and the waist support massage.

9 Claims, 13 Drawing Sheets

ELECTRIC SOFA FRAME

FIELD OF THE INVENTION

The invention relates to the technical field of furniture seats and, in particular, to an electric sofa frame.

BACKGROUND OF THE INVENTION

With the ever-increasing life standards, electric sofas as a kind of life enjoyment have entered homes of ordinary people nowadays. In comparison with traditional sofas, electric sofas have their unique comfort and functions, and thus are welcomed by more people. The electric sofa frame is the core component of an electric sofa. At present, most of the existing electric sofa frames on the market have the functions of leg extension and backrest tilting. However, the back of the electric sofa frame has no function of the waistrest and the headrest. Its functions are limited and cannot satisfy most users.

SUMMARY OF THE INVENTION

In view of the foregoing, one objective of the invention is to provide an electric sofa frame which is simple and compact in structure, stable in operation, and versatile in the functions thereof.

In order to achieve the above-mentioned objective, the invention adopts the following technical solutions:

The disclosed electric sofa frame comprises a bottom frame assembly, a sofa mounting frame, a leg assembly, a back assembly, a linkage mechanism and a first driving electric motor for driving the motion of the linkage mechanism. The movement of the linkage mechanism extends or contracts the leg assembly and/or the back assembly. The invention further comprises a fixing frame, a headrest assembly, a waistrest assembly, a second driving electric motor for rotating the waistrest assembly, and a third driving electric motor for rotating the headrest assembly. The headrest assembly and the waistrest assembly are connected to the back assembly via the fixing frame.

The waistrest assembly includes a first support piece, a first support, a roller, a first active piece, a first shaft body and a first tension spring. One end of the first support piece is mounted on the fixing frame, and the other end thereof, the middle portion of the first support piece and the middle portion of the first active piece are rotatably installed on the first shaft body. The roller is rotatably installed on the other end of the first support. The piston rod of the second driving electric motor is rotatably disposed on one end of the first active piece. The body of the second driving electric motor is rotatably disposed on one end of the fixing frame. The other end of the first active piece is provided with a first protruding post. The first support is provided with a first arc groove for accommodating the first protruding post. Both ends of the first tension spring are respectively disposed at the fixing frame and one end of the first support. The first tension spring is used for tensioning the first support such that the first protruding post urges against the sidewall on one end of the first arc groove.

The headrest assembly includes a second support piece, a second support, a fixing piece, a second active piece, a second shaft body and a second tension spring. One end of the second support piece is installed on the fixing frame. The other end of the second support piece, the middle portion of the second support, and the middle portion of the second active piece are rotatably disposed via the second shaft body.

The fixing piece is disposed vertically with respect to the second support. The piston rod of the third driving electric motor is rotatably disposed on one end of the second active piece. The body of the third driving electric motor is rotatably disposed on one end of the fixing frame. The other end of the second driving piece is provided with a second protruding post. The second support is provided with a second arc groove for accommodating the second protruding post. Both ends of the second tension spring are respectively disposed at the fixing frame and one end of the second support. The second tension spring is used for tensioning the second support such that the second protruding post urges against the sidewall on one end of the second arc groove.

The linkage mechanism includes a transmission rod, a linkage plate, a baffle, a leg linkage assembly and a back linkage assembly. The piston rod of the first driving electric motor is drivingly connected with the transmission rod. The body of the first driving electric motor is connected with and the bottom frame assembly. Both ends of the transmission rod are respectively connected to the linkage plate. The baffle is connected with the transmission rod. One end of the leg linkage assembly is rotatably connected with the linkage plate, and the other end thereof is rotatably connected with the leg assembly. One end of the back linkage assembly is rotatably connected to the linkage plate, and the other end thereof is rotatably connected to the back assembly. The sofa mounting frame is rotatably connected to the linkage plate. The bottom frame assembly is provided with a first limit block. When the leg assembly or the back assembly extends to its limit position, the baffle touches the first limit block.

Furthermore, the back assembly includes a back support frame connected to the sofa mounting frame, a back rotating block hinged to the back support frame, and a back adjustment frame connected to the back rotating block. The back linkage assembly is rotatably connected to the back rotating block. The headrest assembly and the waistrest assembly are connected to the back adjustment frame via the fixing frame.

Furthermore, the leg assembly includes a leg support. The leg linkage assembly is rotatably connected with the leg support. The leg linkage assembly is used to drive the leg support to extend or contract. When in a contract state, the leg linkage assembly and the leg support are folded under the sofa mounting frame.

Furthermore, the leg linkage assembly comprises a first leg link, a second leg link, a third leg link, a fourth leg link, a fifth leg link, and a sixth link leg. One end of the first leg link is hinged to the linkage plate, and the other end thereof is hinged to the middle portion of the second leg link. One end of the second leg link is hinged to the sofa mounting frame, and the other end thereof is hinged to the third leg link. The end of the third leg link that is away from the second leg link is hinged to the leg support. The middle portion of the third leg link is hinged to the middle portion of the fifth leg link. One end of the fourth leg link is rotatably connected to the bottom frame assembly, and the other end thereof is hinged to the fifth leg link. The hinge between the fourth leg link and the fifth leg link is connected to the sofa mounting frame. The end of the fifth leg link that is away from the fourth leg link is hinged to the sixth leg link. The end of the sixth leg link that is away from the fifth leg link is hinged to the leg support.

Furthermore, the bottom frame assembly includes a bottom frame body and an adjustment frame rotatably connected to the bottom frame body. The first driving electric motor is connected with the adjustment frame and drives the adjustment frame to rotate.

In particular, the linkage mechanism drives the leg assembly to expand or contract. The electric sofa frame further includes a fourth driving electric motor for driving the back assembly to expand or contract. The middle portion of the sofa mounting frame is connected with the sofa support rod. The fourth driving electric motor is drivingly connected to the back assembly. The piston rod of the fourth driving electric motor is connected with the sofa support rod.

Furthermore, the back assembly includes a back support frame connected to the sofa mounting frame, a back rotating block hinged to the back support frame, a back adjustment frame connected to the back rotating block, and a back beam connected to the back adjustment frame. The piston rod of the fourth driving electric motor is connected with the back beam. The headrest assembly and the waistrest assembly are connected to the back adjustment frame via the fixing frame.

Beneficial Effects of the Invention

According to the disclosed electric sofa frame, the linkage mechanism can realize motions on the sofa mounting frame under the driving action of the first driving electric motor. Such motions of the linkage mechanism drive the leg assembly and the back assembly to simultaneously expand or contract. This enables the electric sofa frame to realize the functions of leg extension and backrest tilting. At the same time, the headrest assembly and the waistrest assembly mounted on the back assembly can provide support for the head and support and massage for the waist. Therefore, a plurality of parts of the user body gain comfort. The invention thus enhances the comfort and functions of the electric sofa.

DESCRIPTION OF THE PREFERRED EMBODIMENTS

Figure 1:
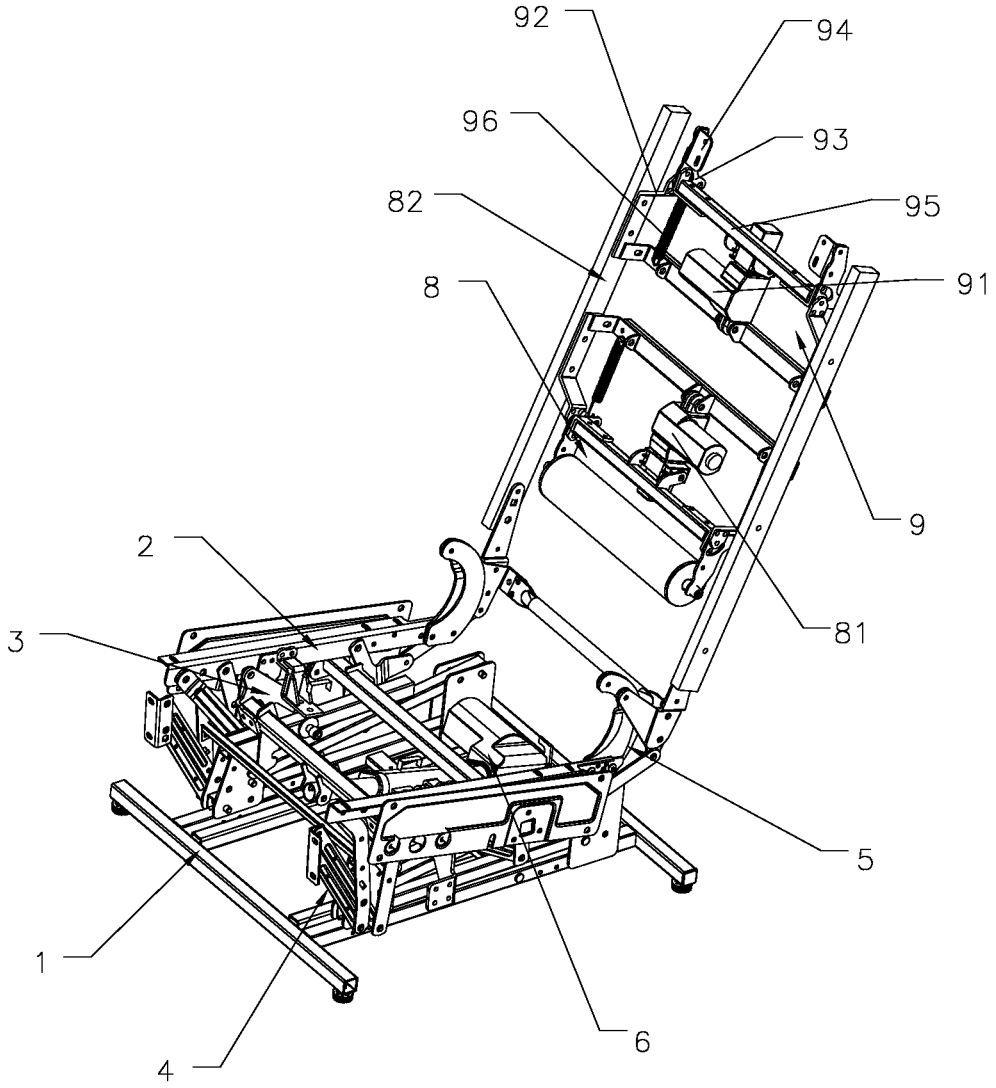
FIG. 1 is a schematic three-dimensional view of the invention.

The aforementioned and other objectives and advantages of this disclosure will become clearer in light of the following detailed description of an illustrative embodiment of this invention described in connection with the drawings.

Embodiment 1

The invention provides an electric sofa frame, which comprises a bottom frame assembly 1, a sofa mounting frame 2, a leg assembly 4, a back assembly 5, a linkage mechanism 3 and a first driving electric motor 6 for driving the linkage mechanism 3 to move. The movement of the linkage mechanism 3 drives the leg assembly 4 and the back assembly 5 to simultaneously expand or contract. The electric sofa frame further includes a fixing frame 82, a headrest assembly 9, a waistrest assembly 8, a second driving electric motor 81 for rotating the waistrest assembly 8, and a third driving electric motor 91 for rotating the headrest assembly 9. The headrest assembly 9 and the waistrest assembly 8 are connected to the back assembly 5 via the fixing frame 82.

In practical applications, the linkage mechanism 3 can realize motions on the sofa mounting frame 2 under the driving action of the first driving electric motor 6. The movement of the linkage mechanism 3 drives the leg assembly 4 and the back assembly 5 to simultaneously expand or contract. This enables the disclosed electric sofa frame to perform the functions of leg extension and backrest tilting. At the same time, the waistrest assembly 8 and the headrest assembly 9 mounted on the back assembly 5 can be used to provide support for the head support and support and massage for the waist. Therefore, several parts of the user body gain comfort. The invention thus enhances the comfort and functions of the electric sofa.

In this embodiment, the disclosed electric sofa is provided with a second driving electric motor 81 and a third driving electric motor 91 for driving the waistrest assembly 8 and the headrest assembly 9 to rotate with respect to the back assembly 5. Specifically, the driving electric motor belongs to the prior art. The driving electric motor is a modular product designed by integrating the servo motor and the lead screw to turn the rotary motion of the servo motor into a linear motion. When it is necessary to change the angle of the headrest assembly 9 or the waistrest assembly 8, the second driving electric motor 81 or the third driving electric motor 91 drives the waistrest assembly 8 or the headrest assembly 9 to rotate, thereby automatically changing the angle of the headrest assembly 9 or the waistrest assembly 8 relative to the back assembly 5 and providing suitable comfort to the user.

Figure 2:
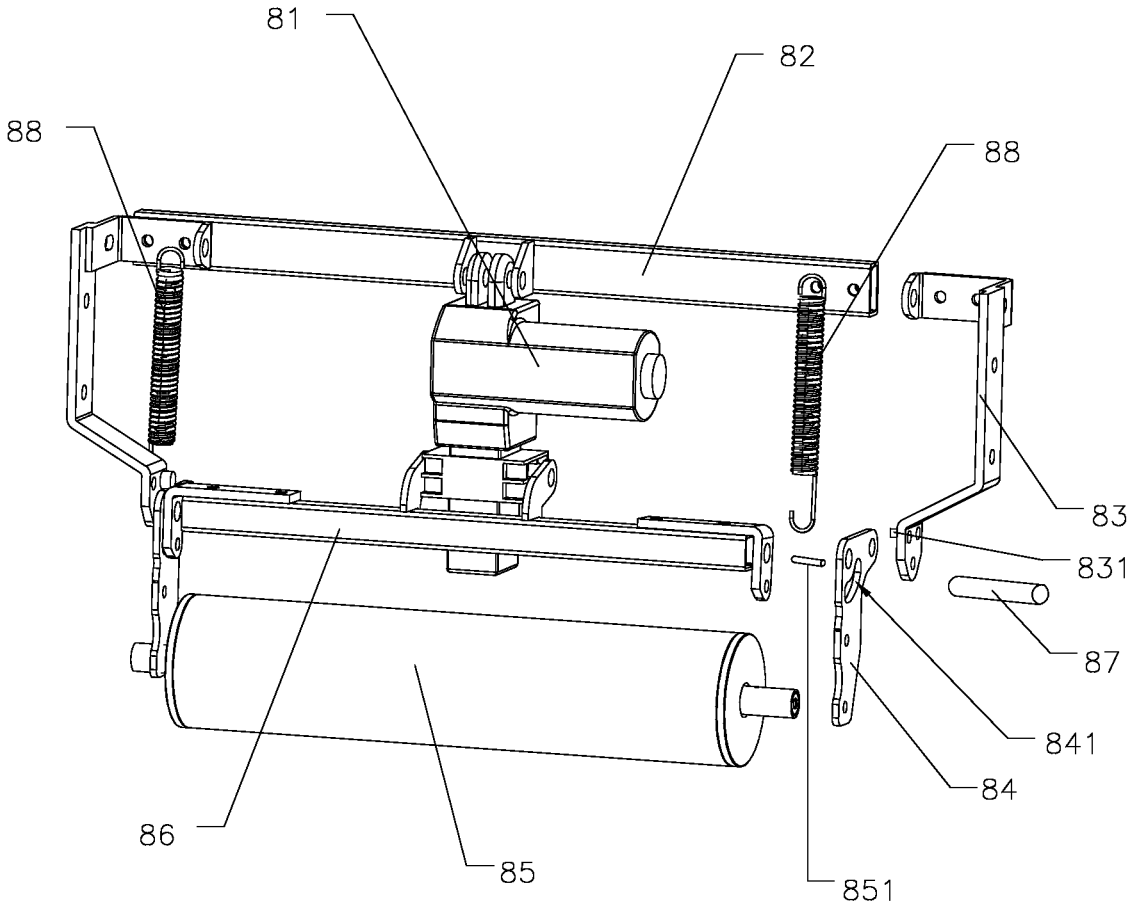
FIG. 2 is a schematic exploded view of the waistrest assembly of the invention.

According to the invention, as shown in FIG. 1 and FIG. 2, the waistrest assembly 8 includes a first support piece 83, a first support 84, a roller 85, a first active piece 86, a first shaft body 87, and a first tension spring 88. One end of the first support piece 83 is mounted on the fixing frame 82. The other end of the first support piece 83, the middle portion of the first support 84, and the middle portion of the first active piece 86 are rotatably arranged via the first shaft body 87. The roller 85 is rotatably disposed at the other end of the first support 84. The piston rod of the second driving electric motor 81 is rotatably disposed on one end of the first active piece 86. The body of the second driving electric motor 81 is rotatably disposed on one end of the fixing frame 82. The other end of the first active piece 86 is provided with a first protruding post 851. The first support 84 is provided with a first arc groove 841 for accommodating the first protruding post 851. Both ends of the first tension spring 88 are respectively disposed at the fixing frame 82 and the first support 84. The first tension spring 88 is used to tension the first support 84 so that the first protruding post 851 urges against the sidewall of one end of the first arc groove 841. The arrangement of the first arc groove 841 can achieve the effect of limiting the rotation range of the active piece, thereby restricting the rotation of the roller 85.

In practical applications, when it is necessary to change the angle of the waistrest assembly 8, the piston rod of the second driving electric motor 81 extends to drive the first active piece 86 to rotate. The first active piece 86 then rotates together with the first protruding post 851. Since the first tension spring 88 tensions the first support 84 such that the first protruding post 851 urges against the sidewall of one end of the first arc groove 841, the rotation of the first protruding post 851 can drive the first support 84 to rotate, until the second driving electric motor 81 drives the waistrest assembly to a desired angle. When the waistrest assembly 8 is required to rotate in the reverse direction, the piston rod of the second driving electric motor 81 retracts, and the first tension spring 88 drives the first support 84 to automatically rotate in the reverse direction under the action of its own elastic force. During the angle adjustment of the waistrest assembly 8, the roller 85 is in contact with the user's waist. The sliding friction between the waistrest assembly 8 and user's waist is converted into rolling friction between the roller 85 and the waist, thereby enhancing the user's comfort.

As shown in FIG. 1, the headrest assembly 9 includes a second support piece 92, a second support 93, a fixing piece 94, a second active piece 95, a second shaft body (not shown), and a second tension spring 96. One end of the second support piece 92 is mounted on the fixing frame 82. The other end of the second support piece 92, the middle portion of the second support 93 and the middle portion of the second driving piece 95 are rotatably disposed via the second shaft body. The fixing piece 94 is vertically disposed with respect to the second support 93. The piston rod of the third driving electric motor 91 is rotatably disposed on one end of the second driving piece 95. The body of the third driving electric motor 91 is rotatably disposed on one end of the fixing frame 82. The other end of the second driving piece 95 is provided with a second protruding post (not shown). The second support 93 is provided with a second arc groove (not shown) for accommodating the second protruding post. Both ends of the second tension spring 96 are respectively disposed on the fixing frame 82 and one end of the second support 93. The second tension spring 96 is used for tensioning the second support 93 so that the second protruding post urges against the sidewall of one end of the second arc groove. The working principle of the headrest assembly 9 is the same as that of the waistrest assembly 8, and will not be repeated herein.

Figure 3:
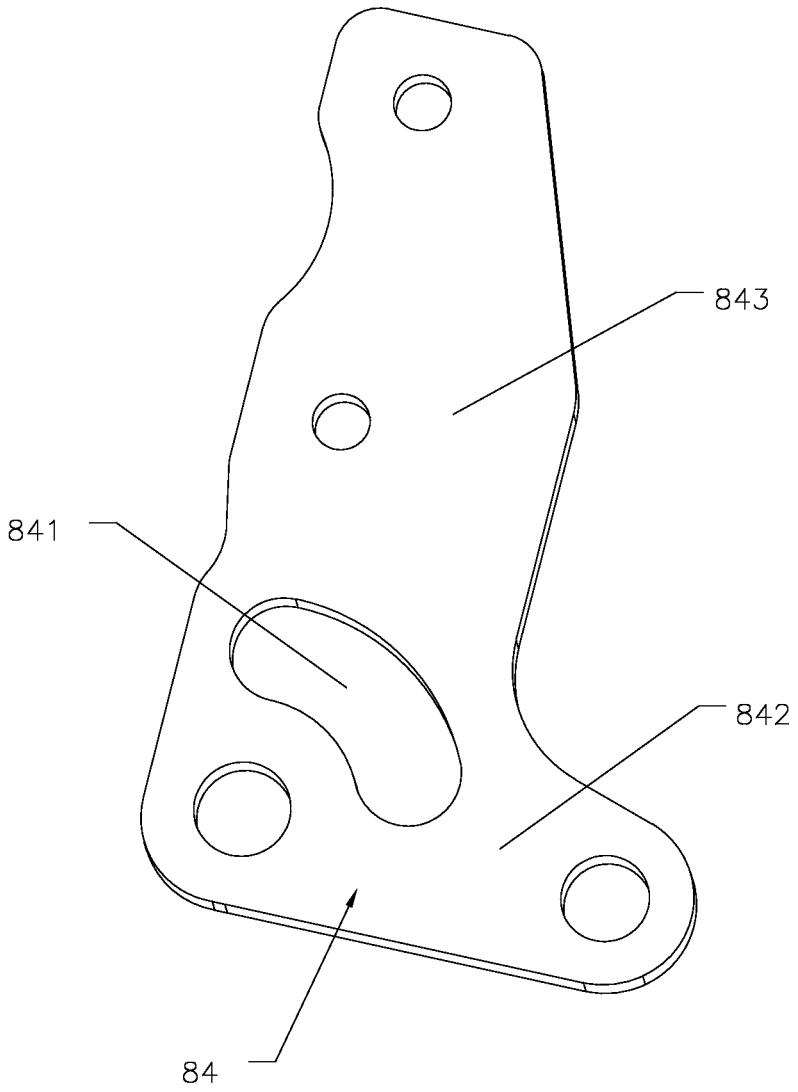
FIG. 3 is a schematic structural view of a first support of the invention.

In a practical application, the fixing piece 94 is installed in an external headrest. Preferably, the fixing piece 94 is provided with a sliding groove (not shown), and the headrest is slidably disposed in the sliding groove. According to the actual heights of different users, the user can slide the headrest on the fixing piece 94, thereby changing the position of the headrest on the fixing piece 94 and ensuring that the headrest assembly 9 can fit users of various heights. The third driving electric motor 91 can drive the second driving piece 95 to rotate, thereby adjusting the angle between the fixing piece 94 and the fixing frame 82. This realizes the angle adjustment of the headrest to meet various needs of the user and to provide suitable comfort to the user. Specifically, as shown in FIG. 3, the first support 6 and the second support are both substantially L-shaped. The first support 84 includes a first arm portion 842 and a second arm portion 843 connected to the first arm portion 842. The connection between the first arm portion 842 and the second arm portion 843 is rotatably arranged with the first shaft body 87. The first arm portion 842 and the second arm portion 843 intersect. The free end of the first arm portion 842 is connected to one end of the tension spring 11, and the free end of the second arm portion 843 is rotatably disposed with the roller 7. The support piece 15 is provided with a stopper 831 for blocking the first arm portion 842 or the second arm portion 843. When the first support 84 rotates forward to its maximum extent, the stopper 831 urges against the second arm portion 843. When the first support 84 is reversely rotated to the maximum extent, the stopper 831 urges against the first arm portion 842 to prevent the first support 84 from an excessive rotation.

Figure 4:
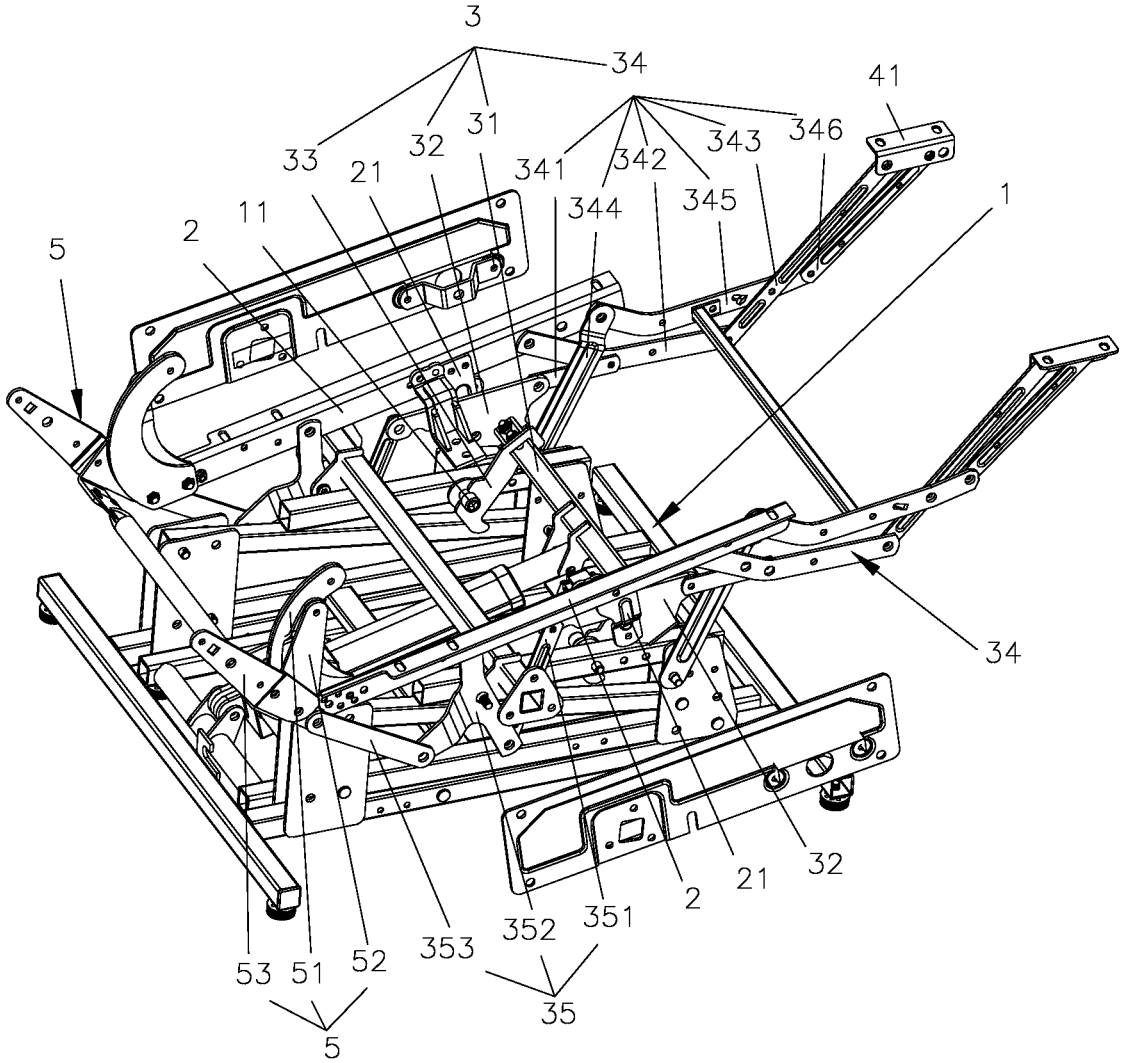
FIG. 4 is a schematic three-dimensional view of the first embodiment after hiding the headrest assembly and the waistrest assembly.

As shown in FIG. 4, the linkage mechanism 3 includes a transmission rod 31, a linkage plate 32, a baffle 33, a leg linkage assembly 34, and a back linkage assembly 35. The piston rod of the first driving electric motor 6 is rotatably connected to the transmission rod 31. The body of the first driving electric motor 6 is connected to the bottom frame assembly 1. Both ends of the transmission rod 31 are connected with the linkage plate 32. The baffle 33 is connected with the transmission rod 31. One end of the leg linkage assembly 34 is rotatably connected to the linkage plate 32, and the other end thereof is rotatably connected to the leg assembly 4. One end of the back linkage assembly 35 is rotatably connected to the linkage plate 32, and the other end thereof is rotatably connected to the back assembly 5. The sofa mounting frame 2 is rotatably connected to the linkage plate 32. When in operation, the first driving electric motor 6 drives the transmission rod 31 to move, and the motion of the transmission rod 31 drives the linkage plate 32 and the baffle 33 to rotate. When the linkage plate 32 rotates, it drives the leg assembly 4 to extend or retract via the leg linkage assembly 34, and also drives the back assembly 5 to extend or contract via the back linkage assembly 35. The bottom frame assembly 1 is provided with a first limit block 11 which, when the leg assembly 4 or the back assembly 5 is extended to its limit position, is urges against the baffle 33 to stop the rotation thereof. When the baffle 33 is stopped from rotation, the transmission rod 31 stops rotation, thereby preventing the linkage plate 32 from rotation. The leg assembly 4 or the back assembly 5 is thus limited within the limit position.

Figure 6:
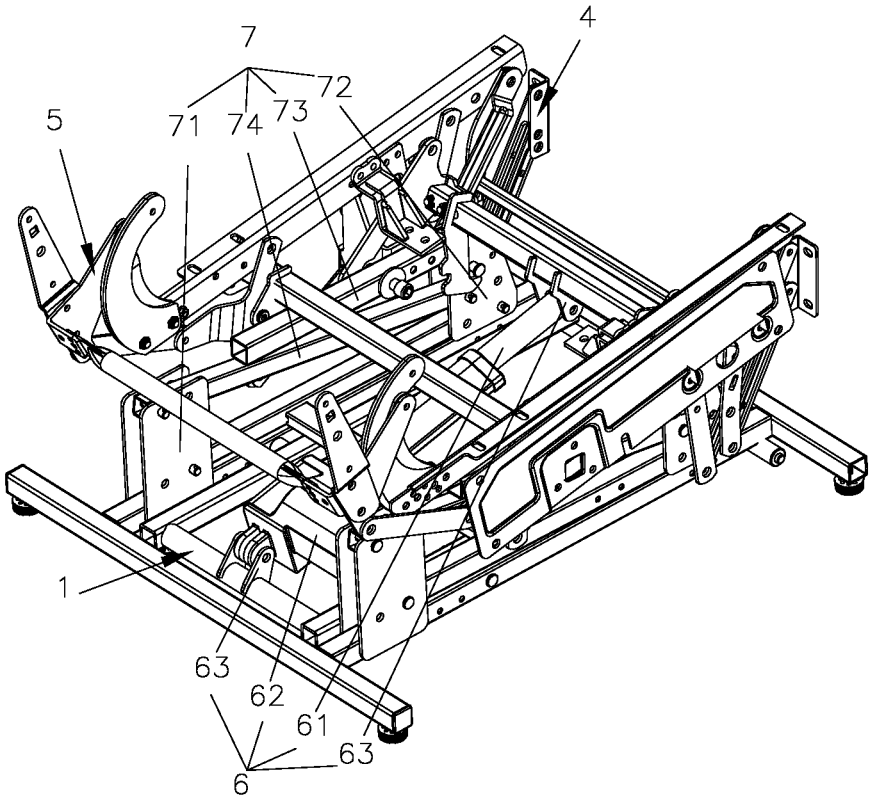
FIG. 6 is a schematic structural view of the first embodiment in a sitting posture.

As shown in FIG. 6, when the sofa frame is in the sitting posture, the piston rod of the first driving electric motor 6 is in an extended state. The leg assembly 4 and the back assembly 5 are both in a contracted state. The leg linkage assembly 34 and the leg assembly 4 are folded under the sofa mounting frame 2.

When the sofa frame needs to be adjusted from the sitting posture to the lying posture, the piston rod of the electric motor contracts and drives the transmission rod 31 to rotate. The rotation of the transmission rod 31 drives the linkage plate 32 and the baffle 33 to rotate together. When the linkage plate 32 rotates, it drives the leg assembly 4 to extend via the leg linkage assembly 34, thereby supporting user's legs. At the same time, the back linkage assembly 35 rotatably connected to the linkage plate 32 drives the back assembly 5 to rotate and extend, thereby adjusting the angle between the leg assembly 4 and the back assembly 5 to meet the user's needs and to put the sofa frame in a lying posture. The extension and contraction of the leg assembly 4 and the back assembly 5 only require the cooperation and rotation of the transmission rod 31, the linkage plate 32, the leg linkage assembly 34 and the back linkage assembly 35. The structure is simple, and the operation is stable and reliable with high transmission accuracy. The baffle 33 rotates in synchronization with the linkage plate 32. When the leg assembly 4 or the back assembly 5 is extended to its limit position, the first limit block 11 urges against the baffle 33 and blocks the rotation of the baffle 33. This stops the transmission rod 31 and the linkage plate 32 from rotating. As a result, the leg assembly 4 or the back assembly 5 cannot continue to be stretched, preventing the leg assembly 4 or the back assembly 5 from being overextended and protecting the linkage mechanism 3. The sofa mounting frame 2 is provided with a sofa link 21, one end of which is hinged to the linkage plate 32 and the other end thereof is connected to the sofa mounting frame 2. The sofa mounting frame 2 is rotatably connected to the linkage plate 32 via the sofa link 21. During operation, the linkage plate 32 rotates along the sofa link 21, so that the rotation thereof is more stable and reliable.

The disclosed electric sofa frame has a simple structure, high operation stability, and a high transmission precision. It effectively prevents the leg assembly 4 or the back assembly 5 from being overextended, and protects the linkage mechanism 3.

Figure 5:
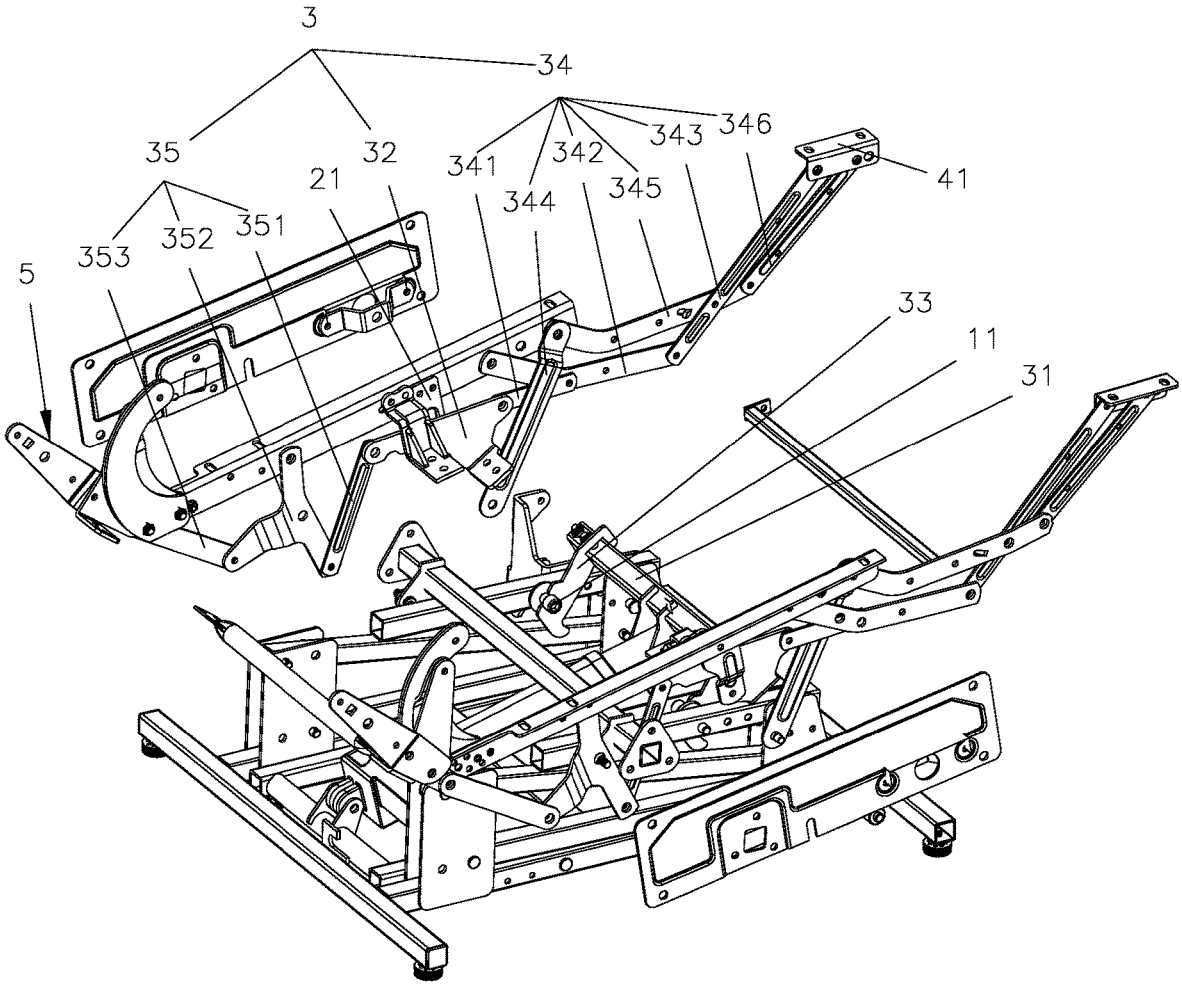
FIG. 5 is a schematic exploded view of the first embodiment.

As shown in FIG. 4 and FIG. 5, the back assembly 5 in this embodiment includes a back support frame 51 connected to the sofa mounting frame 2, a back rotating block 52 hinged to the back support frame 51, and a back adjustment frame 53 connected to the back rotating block 52. The back linkage assembly 35 is rotatably connected to the back rotating block 52. As shown in FIG. 1, the headrest assembly 9 and the waistrest assembly 8 are both connected to the back adjustment frame 53 via the fixing frame 82. The back linkage assembly 35 includes a first back link 351, a back linkage block 352, and a second back link 353. One end of the first back link 351 is hinged with the linkage plate 32, and the other end thereof is hinged with the back linkage block 352. One end of the second back link 353 is hinged with the back linkage block 352, and the other end thereof is hinged with the back rotating block 52. The other end of the back linkage block 352 is hinged to the sofa mounting frame 2.

When the back assembly 5 needs to extend and adjust the angle of the back assembly 5 and the sofa mounting frame 2, the piston rod of the first driving electric motor 6 pushes the transmission rod 31 to move in the direction of the back linkage assembly 35 and drives the transmission rod 31 to rotate. The transmission rod 31 drives the linkage plate 32 to rotate, and the linkage plate 32 drives the back assembly 5 to rotate via the back linkage assembly 35. Specifically, the rotation of the linkage plate 32 pulls the first back link 351 to move in the direction of the linkage plate 32. The movement of the linkage plate 32 pulls the back linkage block 352 to rotate about the sofa mounting frame 2. The rotation of the back linkage block 352 pushes the second link 353 to move away from the linkage plate 32. The movement of the second link 353 drives the back rotating block 52 to rotate around the back support frame 51. The rotation of the back rotating block 52 drives the back adjustment frame 53 to extend upward. This achieves the adjustment of the angle between the back assembly 5 and the sofa mounting frame 2, thereby enabling the back adjustment frame 53 to extend the headrest assembly 9 and the waistrest assembly 8 to the desired position of the user. The structure of the back assembly 5 is simple and compact, and the operation is stable and reliable with a high transmission precision.

In this embodiment, the leg assembly 4 includes a leg support 41. The leg linkage assembly 34 is rotatably connected to the leg support 41. The leg linkage assembly 34 is configured to drive the leg support 41 to expand or contract. The leg linkage assembly 34 and the leg support 41 are folded and under the sofa mounting frame 2.

As shown in FIGS. 4 and 5, the leg linkage assembly 34 includes a first leg link 341, a second leg link 342, a third leg link 343, a fourth leg link 344, a fifth leg link 345 and a sixth leg link 346. One end of the first leg link 341 is hinged to the linkage plate 32, and the other end thereof is hinged to the middle portion of the second leg link 342. One end of the second leg link 342 is hinged to the sofa mounting frame 2, and the other end thereof is hinged to the third leg link 343. The end of the third leg link 343 that is away from the second leg link is hinged with the leg support 41. The middle portion of the third leg link 343 is hinged to the middle portion of the fifth leg link 345. One end of the fourth leg link 344 is rotatably connected to the bottom frame assembly 1 The other end of the fourth leg link 344 is hinged with the fifth leg link 345, and the hinge thereof is rotatably connected with the sofa mounting frame 2. The end of the fifth leg link 345 that is away from the fourth leg link 344 is hinged to the sixth leg link 346. The end of the sixth leg link 346 that is away from the fifth leg link 345 is hinged to the leg support 41.

When the sofa frame is in the sitting posture, i.e., the leg assembly 4 is in a contracted state, the leg linkage assembly 34 and the leg assembly 4 are folded under the sofa mounting frame 2. When it is required to drive the leg assembly 4 to extend, the piston rod of the first driving electric motor 6 contracts and drives the transmission rod 31 to rotate. The transmission rod 31 then drives the linkage plate 32 to rotate. The motion of the linkage plate 32 drives the leg support 41 to extend via the leg linkage assembly 34. Specifically, the rotation of the linkage plate 32 drives the first leg link 341 to move, and the movement of the first leg link 341 drives the second leg link 342 to rotate around the sofa mounting frame 2. The rotation of the second leg link 342 drives the third leg link 343 to rotate. At the same time, the rotation of the third leg link 343 also drives the fifth leg link 345 to rotate. Under the simultaneous rotations of the third leg link 343 and the fifth leg link 345, the leg support 41 is driven to perform an extension motion. This realizes the stretch function of the leg assembly 4. The structural design of the leg linkage assembly 34 is simple and compact, and the operation is stable and reliable with a high transmission precision. When the leg support 41 contracts, the links are sequentially folded and stored under the sofa mounting frame 2. Therefore, the sofa frame of the single-drive device has a compact structure, which effectively saves space and is elegant. The fourth leg link 344 and the fifth leg link 345 are hinged to the sofa mounting frame 2, so that the fourth leg link 344 and the fifth leg link 345 have a support for rotation. The fourth leg link 344 and the fifth leg link 345 can thus operate reliably. Hinged to the bottom frame assembly 1, the fourth leg link 344 has a support for rotation so that the fourth leg link 344 can work reliably.

In this embodiment, the bottom frame assembly 1 includes a bottom frame 13 and an adjustment frame 14 rotatably connected to the bottom frame 13. The first driving electric motor 6 is drivingly connected to the adjustment frame 14 and drives the adjustment frame 14 to rotate.

Figure 7:
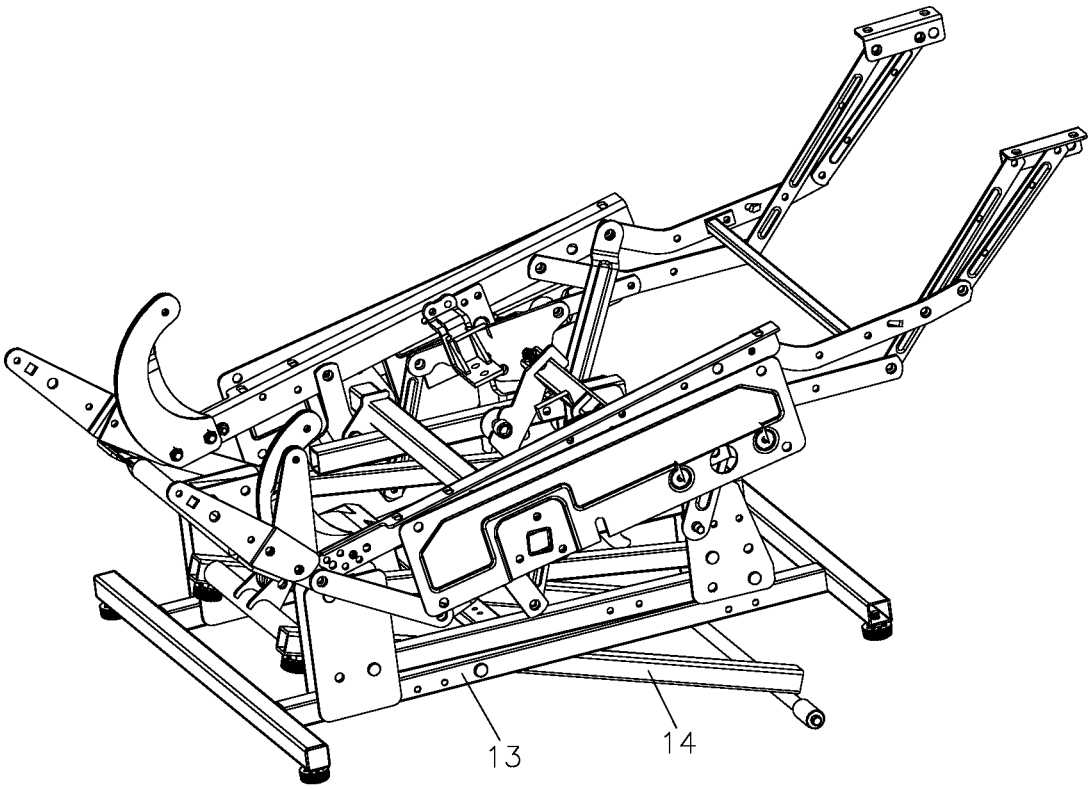
FIG. 7 is a schematic structural view of the first embodiment in a zero gravity posture.
Figure 8:
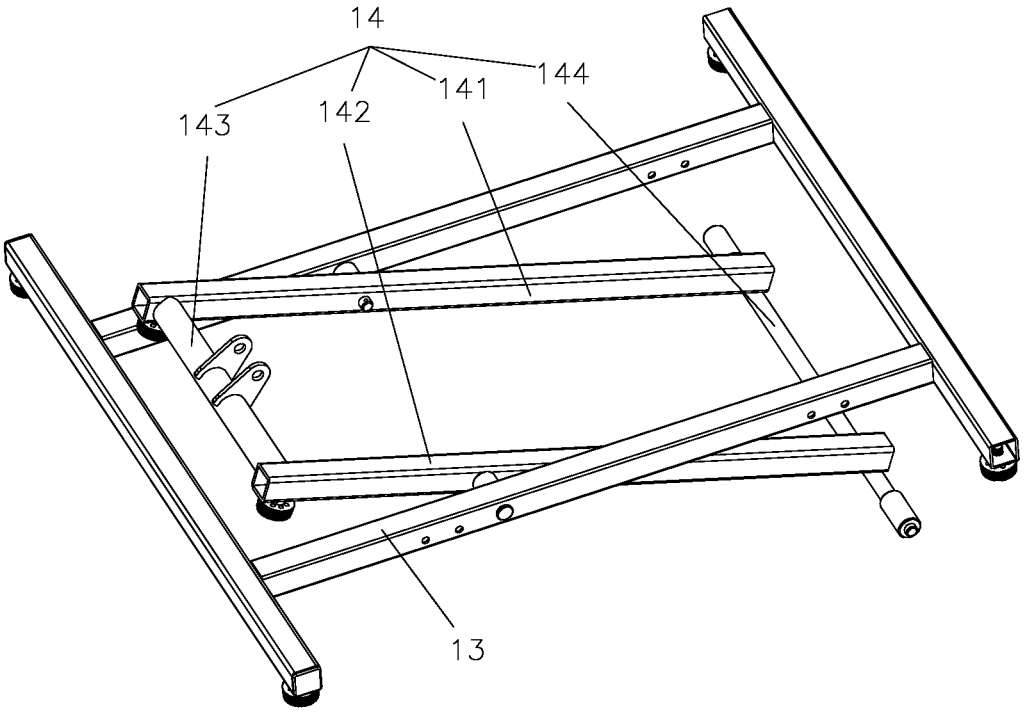
FIG. 8 is a schematic view showing the working state of adjusting the frame in the zero gravity posture according to the first embodiment.
Figure 9:
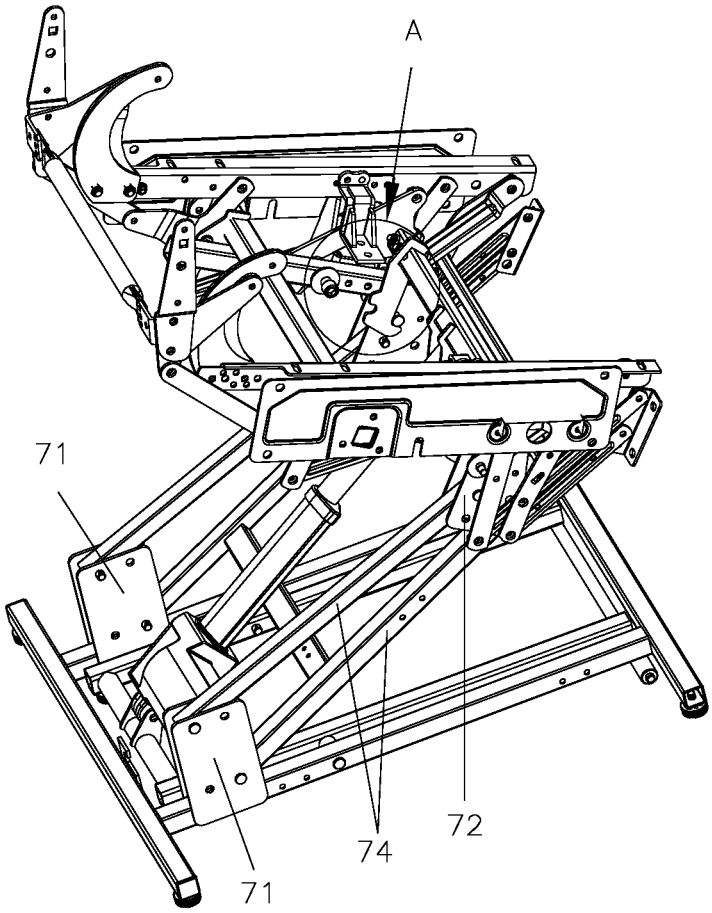
FIG. 9 is a schematic view of the first embodiment in an auxiliary standing posture.
Figure 10:
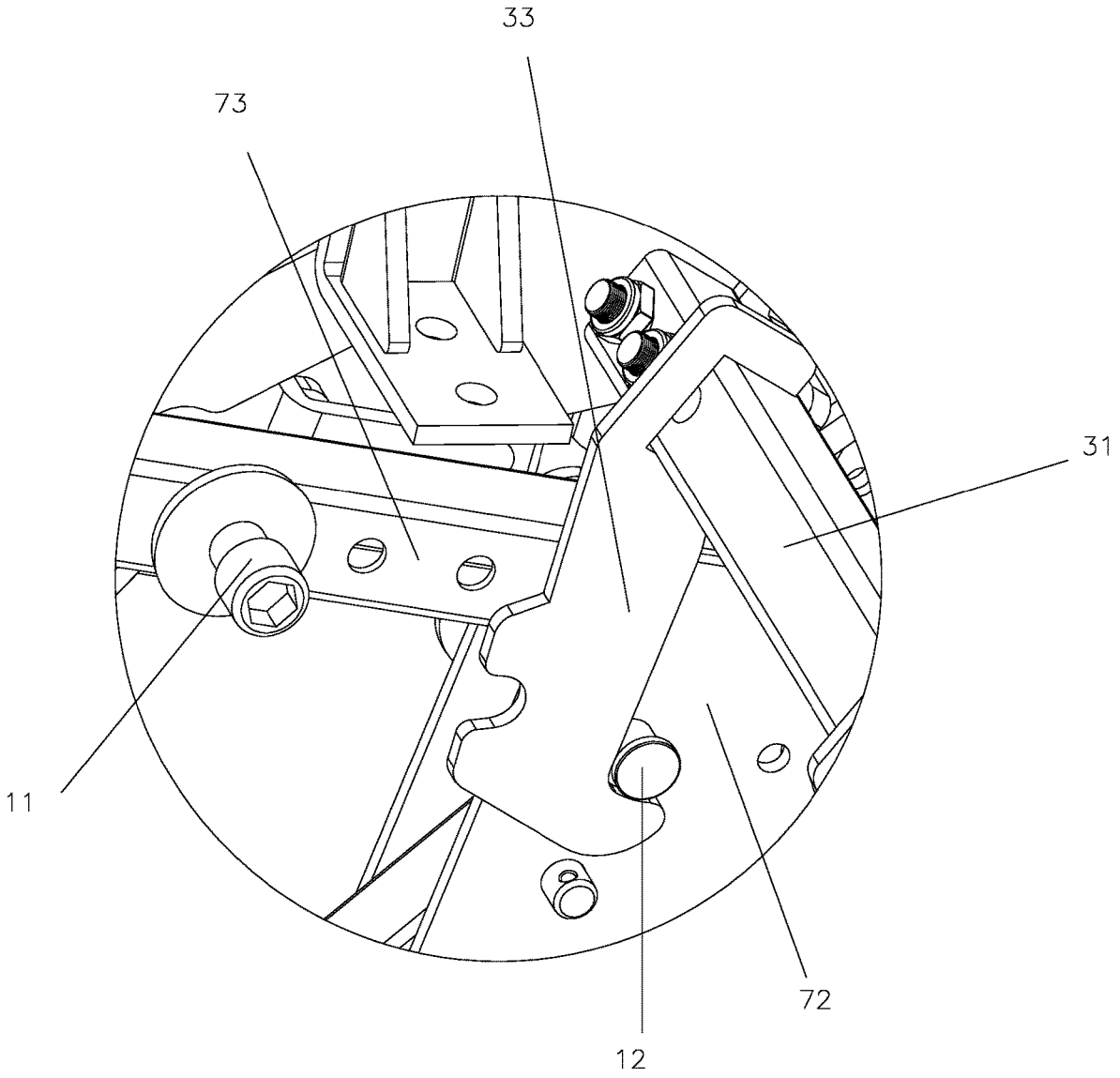
FIG. 10 is a schematic enlarged view of part A of FIG. 9.

As shown in FIG. 7 and FIG. 8, the adjustment frame 14 is disposed in the bottom frame 13. The adjustment frame 14 includes a first rod body 141, a second rod body 142, a third rod body 143 and a fourth rod body 144. Both ends of the first rod body 141 are respectively connected to the third rod body 143 and the fourth rod body 144. Both ends of the second rod body 142 are respectively connected to the third rod body 143 and the fourth rod body 144. The middle portion of the first rod body 141 is hinged to the inner side of the adjacent bottom frame 13. The middle portion of the second rod body 142 is hinged to the inner side of the adjacent bottom frame 13. The first driving electric motor 6 is drivingly connected to the middle portion of the third rod body 143.

When it is required to adjust to a zero-gravity posture, the first driving electric motor 6 first drives the sofa frame to a lying state. The first limit block 11 urges against the baffle 33 and blocks the rotation thereof. The transmission rod 31 and the linkage plate 32 thus stop rotating. Since the transmission rod 31 cannot rotate and the first driving electric motor 6 continues to work, under the reaction force the first driving electric motor 6 can only drive the adjustment frame 14 backwards around its hinge point with the bottom frame 13. One end of the adjustment frame 14 contacts the ground and lifts the disclosed electric sofa frame at an angle, so that the electric sofa frame is in a zero-gravity posture for the human body to get relaxed and rested. The power required to rotate the transmission rod 31 is much less than the power required rotating the adjustment frame 14. Therefore, when the first driving electric motor 6 contracts, the transmission rod 31 is first driven to rotate. When the first limit block 11 urges against the baffle 33 and blocks the rotation thereof, the first driving electric motor 6 reversely drives the adjustment frame 14 to rotate along the hinge point with the bottom frame 13. Specifically, the first driving electric motor 6 drives the first rod body 141 and the second rod body 142 to rotate along the inner side of the bottom frame 13 via the third rod body 143. The first rod body 141 and the second rod body 142 simultaneously drive the fourth rod body 144 to rotate as well. The fourth rod body 144 gradually contacts the ground and lifts the sofa frame at a certain angle, so that the sofa frame is in a zero-gravity posture for the human body to get relaxed and rested.

In this embodiment, the bottom frame assembly 1 further includes a lifting mechanism 7 disposed in the bottom frame 13. The first limit block 11 is disposed at the lifting mechanism 7. The lifting mechanism 7 is further provided with a second limit block 12. The baffle 33 is movable between the first limit block 11 and the second limit block 12.

As shown in FIG. 5 and FIG. 6, the lifting mechanism 7 includes a first connecting plate 71, a second connecting plate 72, a connecting rod 73 and a rotating rod 74. The first connecting plate 71 is connected to the bottom frame 13. The second connecting plate 72 is disposed on the bottom frame 13. The connecting rod 73 is connected to the second connecting plate 72. Both ends of the rotating rod 74 are respectively hinged to the first connecting plate 71 and the second connecting plate 72. The first limit block 11 is disposed on the connecting rod 73. The second limit block 12 is disposed on the second connecting plate 72.

When the sofa frame is in the sitting posture, the first driving electric motor 6 is in an extended state, and the baffle 33 urges against the second limit block 12. The leg assembly 4 and the back assembly 5 are both in a contracted state. The leg linkage assembly 34 and the leg assembly 4 are folded under the sofa mounting frame 2.

Suppose the sofa frame needs to be adjusted from the sitting posture to the auxiliary standing posture. Since the second limit block 12 is disposed in the lifting mechanism 7 via the baffle 33 urges against the second limit block 12 so that the power of the baffle 33 is transmitted to the lifting mechanism 7 through the second limit block 12. The first driving electric motor 6 drives the lifting mechanism 7 to raise the sofa frame via the transmission rod 31, the baffle 33, and the second limit block 12. The sofa frame tilts forward while being raised, thereby assisting the user to stand up. It can help the elderly, the weak, the sick and the pregnant to stand up from the sitting posture. It avoids the inconvenience of the elderly, and reduces the pain of the patient when they stand up. It greatly improves the convenience of use. Specifically, the baffle 33 is buckled against the second limit block 12. When the first driving electric motor 6 drives the transmission rod 31 to move in the direction away from the bottom frame 13, the second limit block 12 prevents the baffle 33 from rotating. As a result, the transmission rod 31 cannot rotate, and the transmission rod 31 can only rise or fall under the driving action of the first driving electric motor 6. The transmission rod 31 drives the second connecting plate 72 to move upward via the baffle 33 and the second limit block 12. During the ascending process of the second connecting plate 72, the connecting rod 73 rises along with the second connecting plate 72 to provide rotational support for the linkage mechanism 3. The rotating rod 74 rotates along with the connecting plate 71 using the second connecting plate 72 as the pivot point, thereby assisting the user to stand up. It helps the elderly, the weak, the sick and the pregnant to stand up from the sitting posture. It avoids the inconvenience of the elderly, and reduces the pain of the patient when they stand up. It greatly improves the convenience of use.

As shown in FIG. 6, in the embodiment the first driving electric motor 6 includes a piston rod 61 and a motor 62 for driving the piston rod 61 to extend and contract. The transmission rod 31 and the adjustment frame 14 are respectively provided with a lug bracket 63. Both ends of the piston rod 61 are respectively connected to the transmission rod 31 and the adjustment frame 14 via the lug bracket 63. Both ends of the piston rod 61 are respectively rotatably connected to the corresponding lug brackets 63.

The lying posture and the zero-gravity posture of the sofa frame are driven by the motor 62 to drive the piston rod 61. The assisted standing posture of the sofa frame is driven when the motor 62 drives to extend the piston rod 61. The motor 62 adjusts the contraction or extension extent of the piston rod 61 according to the lying, zero-gravity and assisted standing postures of the sofa frame. In the lying posture, the motor 62 can drive the transmission rod 31 to rotate within a certain range via the piston rod 61 and the corresponding lug bracket 63. In the zero-gravity posture, the motor 62 can drive the adjustment frame 14 to rotate within a certain range via the piston rod 61 and the corresponding lug bracket 63. In the assisted standing posture, the motor 62 can drive the sofa frame to rise via the piston rod 61, the corresponding lug bracket 63, and the transmission rod 31, the baffle 33, the second limit block 12, and the lifting mechanism 7. This kind of sofa frame only needs one motor to realize the postures of sitting, lying, zero gravity and assisted standing. The invention simplifies the structure and achieves a high transmission efficiency.

Embodiment 2

Figure 11:
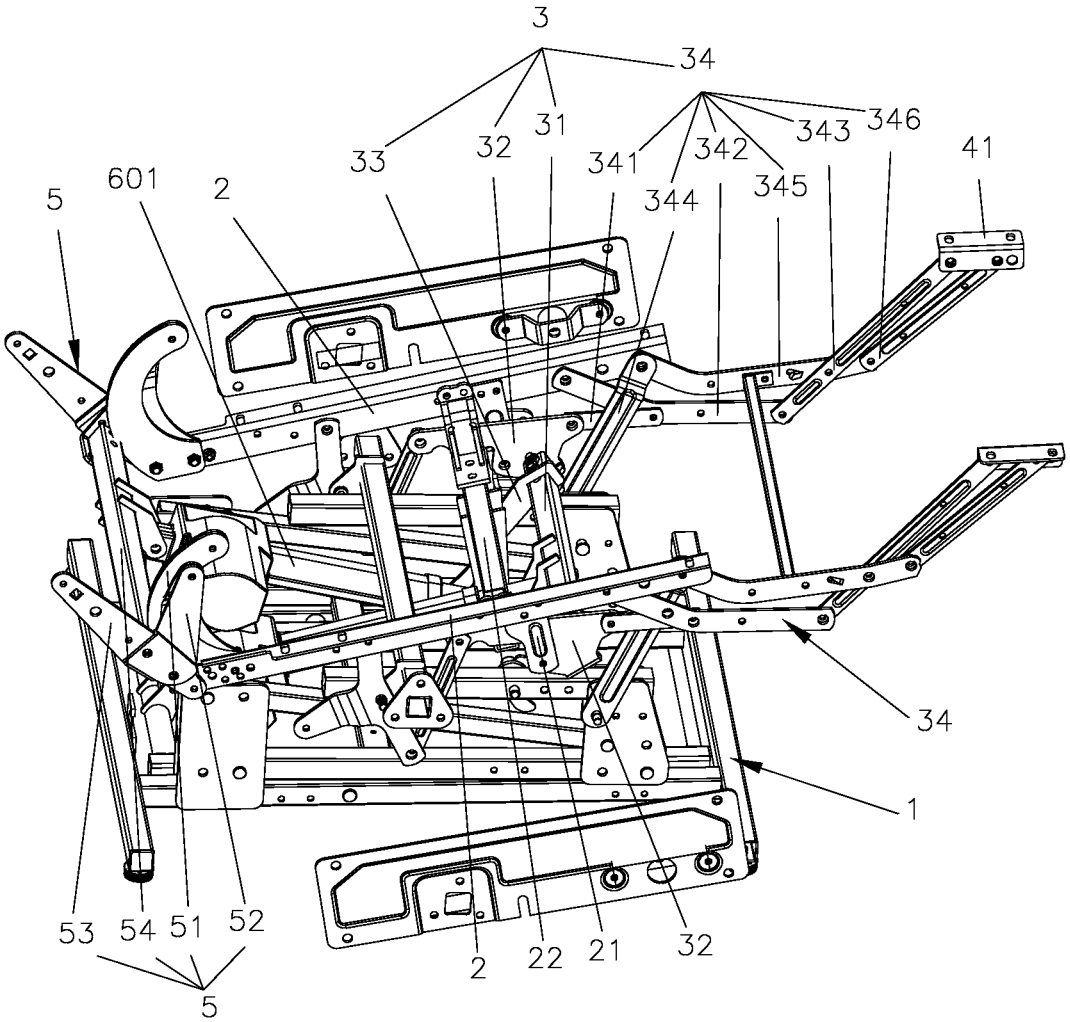
FIG. 11 is a three-dimensional view showing the second embodiment of the invention after hiding the headrest assembly and the waistrest assembly.

The second embodiment of the invention differs from the first embodiment in that, as shown in FIG. 11, the movement of the linkage mechanism 3 drives the leg assembly 4 to expand or contract. The disclosed electric sofa frame further includes a fourth driving electric motor 601 for driving the back assembly 5 to extend or contract. The middle portion of the sofa mounting frame is connected with a sofa support rod 22. The piston rod of the fourth driving electric motor 601 is drivingly connected with the back assembly 5. The body of the fourth driving electric motor 601 and the sofa support rod 22 are connected. In a practical application, the invention uses the first driving electric motor 6 to drive the leg assembly 4 to extend or contract via the linkage mechanism 3. The fourth driving electric motor 601 is used to drive the back assembly 5 to extend or contract. The leg assembly 4 and the back assembly 5 are driven independently. This enhances the operability of the disclosed electric sofa frame. The leg assembly 4 and the back assembly 5 are thus more flexible, enhancing the applicability and comfort of the disclosed electric sofa.

Figure 12:
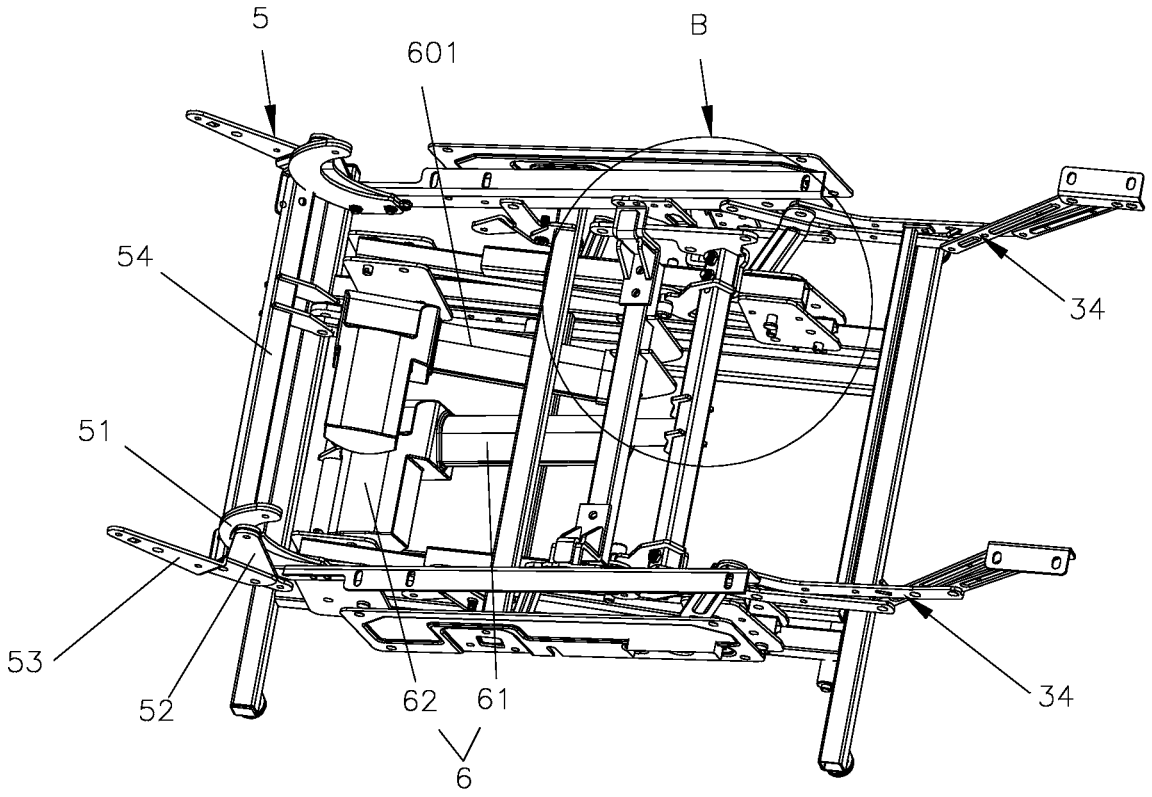
FIG. 12 is a three-dimensional view of the second embodiment from another perspective.
Figure 13:
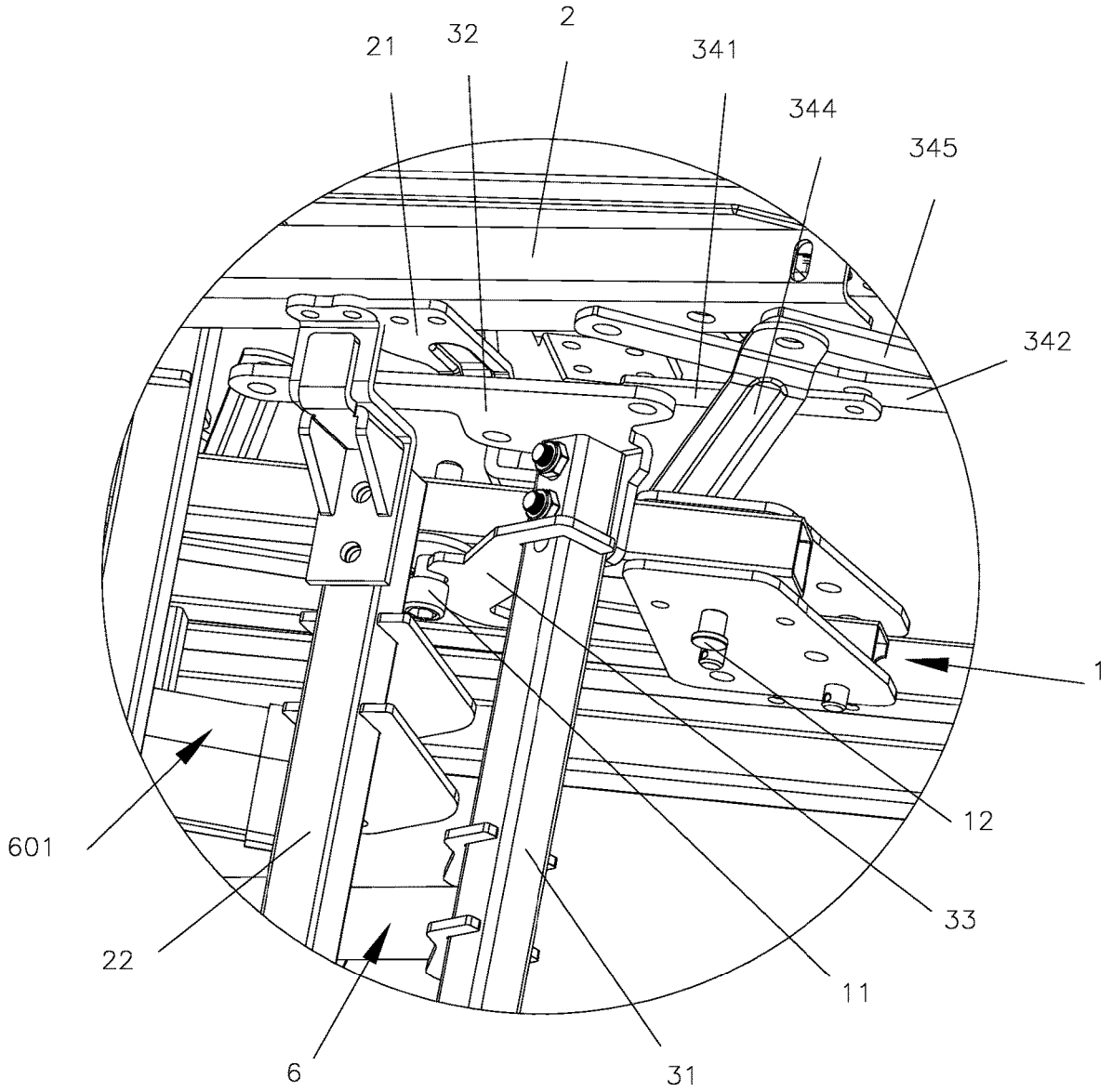
FIG. 13 is a schematic enlarged view of part B of FIG. 12.

As shown in FIGS. 11 to 13, the back assembly 5 includes a back support frame 51 connected to the sofa mounting frame 2, a back rotating block 52 hinged to the back support frame 51, a back adjustment frame 53 connected to the back rotating block 52, and a back beam 54 connected to the back adjustment frame 53. The piston rod of the fourth driving electric motor 601 is connected to the back beam 54. As shown in FIG. 1, the headrest assembly 9 and the waistrest assembly 8 are connected to the back adjustment frame 53 via the mounting frame 82.

In practical applications, when the back assembly 5 needs to extend and adjust the angle between the back assembly 5 and the sofa mounting frame 2, the piston rod of the fourth driving electric motor 601 contracts and drives the back beam 54 to rotate. Since the sofa support rod 22 is fixedly connected to the sofa mounting frame 2, the sofa mounting frame 2 does not rotate. Therefore, the piston rod of the fourth driving electric motor 601 can only drive the back beam 54 to rotate when it contracts. The back beam 54 drives the back adjustment frame 53 and the back rotating block 52 to rotate together. The back rotating block 52 rotates around the hinge with the back support frame 51 to adjust the angle between the back assembly 5 and the sofa mounting frame 2, thereby satisfying user's needs. In this embodiment, the back beam 54 rotates within a certain range under the driving force of the fourth driving electric motor 601, to realize the function of adjusting the angle between the back assembly 5 and the sofa mounting frame 2. The back assembly 5 and the fourth driving electric motor 601 have a simple structure and high transmission efficiency. The fourth driving electric motor 601 can individually control the extension or contraction of the back assembly 5, and has high operability.

While the invention is described in some detail hereinbelow with reference to certain illustrated embodiments, it is to be understood that there is no intent to limit it to those embodiments. On the contrary, the aim is to cover all modifications, alternatives and equivalents falling within the spirit and scope of the invention as defined by the appended claims.

What is claimed is:

1. An electric sofa frame, comprising: a bottom frame assembly, a sofa mounting frame, a leg assembly, a back assembly, a linkage mechanism, a first driving electric motor for driving the movement of the linkage mechanism, a fixing frame, a headrest assembly, a waistrest assembly, a second driving electric motor for rotating the waistrest assembly, and a third driving electric motor for rotating the headrest assembly; wherein the movement of the linkage mechanism extends or contracts the leg assembly and/or the back assembly;

the headrest assembly and the waistrest assembly are connected to the back assembly via the fixing frame;

the waistrest assembly includes a first support piece, a first support, a roller, a first active piece, a first shaft body and a first tension spring;

one end of the first support piece is mounted on the fixing frame, and the other end of the first support piece, a middle portion of the first support and a middle portion of the first active piece are rotatably installed on the first shaft body;

the roller is rotatably installed on the other end of the first support;

a piston rod of the second driving electric motor is rotatably disposed on one end of the first active piece;

the body of the second driving electric motor is rotatably disposed on one end of the fixing frame;

the other end of the first active piece is provided with a first protruding post;

the first support is provided with a first arc groove for accommodating the first protruding post;

both ends of the first tension spring are respectively disposed at the fixing frame and one end of the first support; and the first tension spring is used for tensioning the first support such that the first protruding post urges against the sidewall on one end of the first arc groove.

2. The electric sofa frame of claim 1, wherein the headrest assembly includes a second support piece, a second support, a fixing piece, a second active piece, a second shaft body and a second tension spring; wherein one end of the second support piece is installed on the fixing frame, the other end of the second support piece, a middle portion of the second support, and a middle portion of the second active piece are rotatably disposed via the second shaft body;

the fixing piece is disposed vertically with respect to the second support;

a piston rod of the third driving electric motor is rotatably disposed on one end of the second active piece;

the body of the third driving electric motor is rotatably disposed on one end of the fixing frame;

the other end of the second driving piece is provided with a second protruding post;

the second support is provided with a second arc groove for accommodating the second protruding post;

both ends of the second tension spring are respectively disposed at the fixing frame and one end of the second support; and the second tension spring is used for tensioning the second support such that the second protruding post urges against the sidewall on one end of the second arc groove.

3. The electric sofa frame of claim 1, wherein the linkage mechanism includes a transmission rod, a linkage plate, a baffle, a leg linkage assembly and a back linkage assembly; wherein a piston rod of the first driving electric motor is drivingly connected with the transmission rod;

the body of the first driving electric motor is connected with and the bottom frame assembly;

both ends of the transmission rod are respectively connected to the linkage plate;

the baffle is connected with the transmission rod;

one end of the leg linkage assembly is rotatably connected with the linkage plate, and the other end thereof is rotatably connected with the leg assembly;

one end of the back linkage assembly is rotatably connected to the linkage plate, and the other end thereof is rotatably connected to the back assembly;

the sofa mounting frame is rotatably connected to the linkage plate;

the bottom frame assembly is provided with a first limit block; and when the leg assembly or the back assembly extends to its limit position, the baffle touches the first limit block.

4. The electric sofa frame of claim 3, wherein the back assembly includes a back support frame connected to the sofa mounting frame, a back rotating block hinged to the back support frame, and a back adjustment frame connected to the back rotating block; the back linkage assembly is rotatably connected to the back rotating block; and the headrest assembly and the waistrest assembly are connected to the back adjustment frame via the fixing frame.

5. The electric sofa frame of claim 3, wherein the leg assembly includes a leg support; the leg linkage assembly is rotatably connected with the leg support; the leg linkage assembly is used to drive the leg support to extend or contract; and when in a contract state, the leg linkage assembly and the leg support are folded under the sofa mounting frame.

6. The electric sofa frame of claim 5, wherein the leg linkage assembly comprises a first leg link, a second leg link, a third leg link, a fourth leg link, a fifth leg link, and a sixth link leg;

one end of the first leg link is hinged to the linkage plate, and the other end thereof is hinged to a middle portion of the second leg link;

one end of the second leg link is hinged to the sofa mounting frame, and the other end thereof is hinged to the third leg link;

the end of the third leg link that is away from the second leg link is hinged to the leg support;

a middle portion of the third leg link is hinged to a middle portion of the fifth leg link;

one end of the fourth leg link is rotatably connected to the bottom frame assembly, and the other end thereof is hinged to the fifth leg link;

the hinge between the fourth leg link and the fifth leg link is connected to the sofa mounting frame;

the end of the fifth leg link that is away from the fourth leg link is hinged to the sixth leg link; and the end of the sixth leg link that is away from the fifth leg link is hinged to the leg support.

7. The electric sofa frame of claim 3, wherein the bottom frame assembly includes a bottom frame body and an adjustment frame rotatably connected to the bottom frame body; and the first driving electric motor is connected with the adjustment frame and drives the adjustment frame to rotate.

8. The electric sofa frame of claim 1, wherein the linkage mechanism drives the leg assembly to expand or contract; the electric sofa frame further includes a fourth driving electric motor for driving the back assembly to expand or contract; a middle portion of the sofa mounting frame is connected with the sofa support rod; the fourth driving electric motor is drivingly connected to the back assembly; and a piston rod of the fourth driving electric motor is connected with the sofa support rod.

9. The electric sofa frame of claim 8, wherein the back assembly includes a back support frame connected to the sofa mounting frame, a back rotating block hinged to the back support frame, a back adjustment frame connected to the back rotating block, and a back beam connected to the back adjustment frame; the piston rod of the fourth driving electric motor is connected with the back beam; and the headrest assembly and the waistrest assembly are connected to the back adjustment frame via the fixing frame.

* * * * *